US006853672B2

(12) United States Patent
Holzgruber et al.

(10) Patent No.: US 6,853,672 B2
(45) Date of Patent: Feb. 8, 2005

(54) METHOD FOR PRODUCING METAL BLOCKS OR BARS BY MELTING OFF ELECTRODES AND DEVICE FOR CARRYING OUT THIS METHOD

(75) Inventors: Wolfgang Holzgruber, Bruck a.d. Mur (AU); Harald Holzgruber, Bruck a.d. Mur (AU); Lev Medovar, Kyiy (UA); Lantsman Izrail, Kyiv (UA)

(73) Assignee: Inteco Internationale Technische Beratung Ges.mbH, Bruck a.d. Mur (AT)

( * ) Notice: Subject to any disclaimer, the term of this patent is extended or adjusted under 35 U.S.C. 154(b) by 0 days.

(21) Appl. No.: 10/416,174

(22) PCT Filed: Nov. 9, 2001

(86) PCT No.: PCT/EP01/13014

§ 371 (c)(1),
(2), (4) Date: May 8, 2003

(87) PCT Pub. No.: WO02/38820

PCT Pub. Date: May 16, 2002

(65) Prior Publication Data

US 2004/0026380 A1 Feb. 12, 2004

(30) Foreign Application Priority Data

Nov. 10, 2000 (AT) ..... 1893/2000

(51) Int. Cl.[7] ..... H05B 3/60
(52) U.S. Cl. ..... 373/42; 373/47; 373/67
(58) Field of Search ..... 373/42, 46–50, 373/67, 69, 70; 164/263, 465, 470, 484; 75/10.25

(56) References Cited

U.S. PATENT DOCUMENTS

| | | | | | |
|---|---|---|---|---|---|
| 513,270 | A | * | 1/1894 | Kreinsen | 373/67 |
| 531,143 | A | * | 12/1894 | Woodfolk et al. | 373/76 |
| 2,880,483 | A | * | 4/1959 | Hanks et al. | 164/469 |
| 2,942,045 | A | * | 6/1960 | Johnson | 373/70 |
| 3,495,018 | A | * | 2/1970 | Murtland, Jr. et al. | 373/70 |
| 3,619,464 | A | * | 11/1971 | Holzgruber et al. | 373/49 |
| 3,868,473 | A | * | 2/1975 | Dimick | 373/70 |
| 5,974,075 | A | * | 10/1999 | Kompan | 373/42 |

FOREIGN PATENT DOCUMENTS

| | | |
|---|---|---|
| DE | 196 14 182 | 7/1997 |
| EP | 0 786 521 | 7/1997 |
| FR | 2 447 972 | 10/1980 |
| GB | 1 246 676 | 9/1971 |
| SU | 1768657 | 10/1980 |

* cited by examiner

*Primary Examiner*—Tu Hoang
(74) *Attorney, Agent, or Firm*—Bachman & LaPointe, P.C.

(57) ABSTRACT

A method for producing metal ingots or billets, especially from steels and Ni- and Co- base alloys, by melting off consumable electrode in an electroconductive slag bath using alternating or direct current in a short, downwardly opening, water-cooled mould through which a current contact can be established with the slag bath. The melting current is introduced into the slag bath through the consumable electrode and through the mould in a controlled manner in terms of regulating the distribution of the current between the electrode and the mould; and is conducted back through the mould and the block and the base plate at option; the division of the currents being adjustable in a controlled manner. The proportion of the overall melting current delivered that is delivered via the consumable electrode can be chosen from between 0 and 100%. A device for carrying out the method has a short, water-cooled mould comprising a base plate and at least one current-conducting element provided in the area of the slag bath, this element being insulated in relation to the lower area of the mould which forms the remelting block; or from other current-conducting elements. The supply of the melting current from at least one current source to the consumable electrode and to at least one current conducting element can be specifically adjusted either separately or jointly by means of a suitable arrangement. The return to the at least one current source from at least one current-conducting element of the mould and the base plate which supports the remelting block can be specifically adjusted either separately or jointly.

18 Claims, 3 Drawing Sheets

Fig. 2
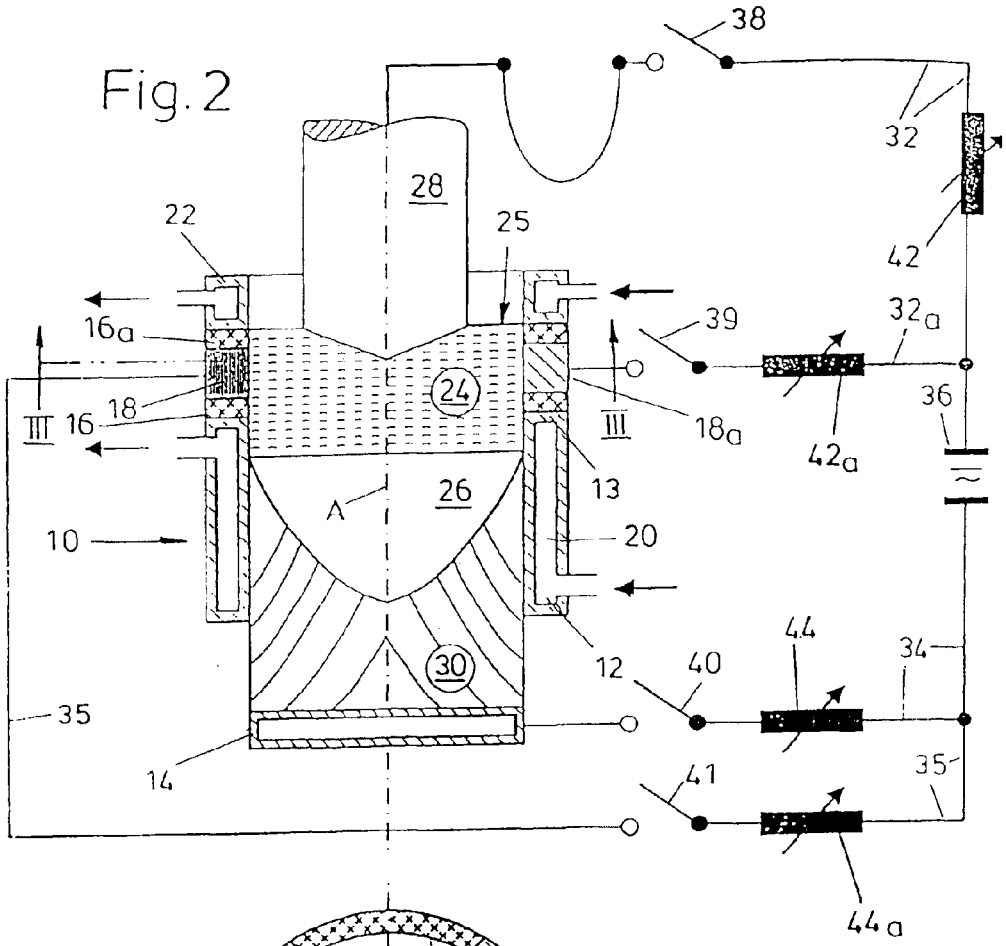
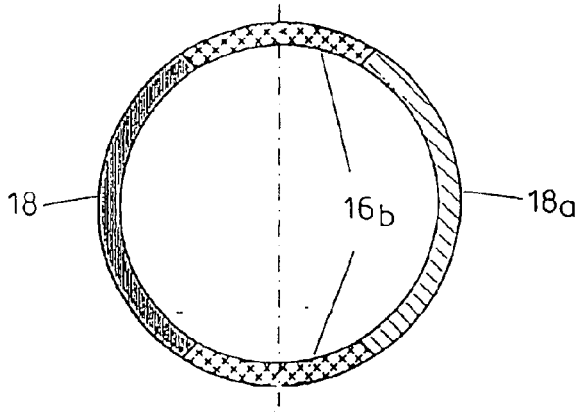
Fig.3

METHOD FOR PRODUCING METAL BLOCKS OR BARS BY MELTING OFF ELECTRODES AND DEVICE FOR CARRYING OUT THIS METHOD

BACKGROUND OF THE INVENTION

The invention concerns a method of producing ingots or billets of metal—in particular steels and Ni- and Co-based alloys—by melting self-consuming electrodes in an electrically conductive slag bath using alternating current or direct current in a short, downwardly open water-cooled mold by way of which current contact with the slag bath can be made. The invention further concerns an apparatus for carrying out that method.

When producing remelt ingots in accordance with the method of electroslag remelting in stationary chill molds—but also in short sliding chill molds—it is usual, depending on the susceptibility to segregation of the remelted alloy, to set a melting rate in kilograms (kg) per hour, which in the case of round ingots is between 70% and 110% of the ingot diameter in millimeters (mm). In the case of ingot shapes which differ from a round cross-section such as square or flat formats, it is possible to operate with an equivalent diameter which is calculated from the periphery of the cross-section, divided by the number $\pi$ (pi). The lower range is used in particular in relation to severely segregating alloys—such as tool steels or highly alloyed nickel-based alloys—, in relation to which the aim is to have a shallow metal sump for the avoidance of segregation phenomena. It is however scarcely possible to get below the value of 70% in the conventional electroslag remelting process as then the supply of power from the melting electrode into the slag bath has to be very greatly reduced, and that results in a low temperature of the slag bath and, as a further consequence, a poor, often grooved surface of the remelt ingot. With an excessively low supply of power to the slag bath a thick coating of slag is then also formed in many cases between the ingot and the mold, which in turn impedes the dissipation of heat from the surface of the ingot so that once again it is not possible to achieve the desired shallow molten bath sump. On the other hand however even in the case of steels and alloys which are less sensitive to segregation, it is not possible to exceed a value of 110% in the case of the conventional electroslag remelting process, referred to as the ESR method, as otherwise overheating of the slag bath together with the increased melting rate results in a molten bath sump which is unacceptably deep for remelt ingots, and thus an undesirably coarse ingot structure—linked to segregation phenomena. As can be readily seen from the foregoing, in the conventional ESR method in which the melting current is passed into the slag bath by way of the melting electrode and is removed again by way of the remelted ingot and the bottom plate, the slag bath temperature and the melting rate—and related thereto the sump depth and the nature of the surface—are closely linked together and cannot be monitored and controlled independently of each other and separately.

When producing remelt ingots of large diameter of 1000 mm and above, it is found that observing the above-indicated, desired low melting rates, particularly when using melting electrodes of large diameter, corresponding to 65 to 85% of the chill mold diameter, results in an excessively low slag bath temperature which then in turn results in the remelt ingot having a poor, often grooved surface. If in that case the supply of power to the slag bath is increased, that admittedly results in an improvement in the ingot surface, but at the same time that causes an increase in the melting rate above the admissible limit, which results in a deeper molten bath sump and disadvantageous hardening. That increase in the melting rate with an increased supply of power to the slag bath occurs for the reason that the melting electrode serves on the one hand to supply energy to the slag bath, but on the other hand it melts away correspondingly more quickly, the more the supply of energy to the slag bath is increased. The electrode then has to be suitably adjusted by movement into the slag bath at the speed at which it melts away. If the melting electrode were not adjusted in that way, it would melt away until just above the surface of the slag bath, whereby electrical contact and thus the supply of power to the slag bath would be interrupted. The remelting procedure would thus come to a stop.

Another way of increasing the slag bath temperature is that of remelting electrodes of smaller diameter. In that case the end face of the electrode, which dips into the slag bath, is smaller so that a comparatively hotter slag bath is required in order to achieve the desired melting rate. Admittedly, in many cases it is possible in that way to achieve an improvement in the surface of the ingot, but the use of electrodes of small diameter results in an increased concentration of heat in the center of the ingot, which can result in a sump which is depressed in a V-shape, with an increased tendency to segregation.

The cause of all the above-indicated difficulties is the fact that on the one hand the melting rate of the electrode is controlled by the energy which is fed to the slag bath by way of the electrode, and on the other hand it is precisely that feed of energy that must also be sufficient to keep the molten bath sump sufficiently fluid as far as the edge thereof and reliably to prevent a temporary progression of hardening beyond the meniscus of the molten bath sump. More specifically, if an excessively low temperature of the slag bath temporarily causes such a progression of hardening beyond the meniscus, that results in the formation of a grooved surface which is detrimental in terms of further processing of the ingots.

The present applicants' EP 786 521 B1 discloses a method of electroslag remelting, in which higher melting rates are set by melting electrodes of comparatively large diameter, than in the conventional electroslag remelting procedure. In the described method the return of a part of the melting current can be implemented by way of current-conducting elements which are installed in the wall of the chill mold. The arrangement results in a distribution of the return currents in inverse proportion to the total resistances of the conductor loops used.

In consideration of those factors the inventor set himself the aim of being able to control the melting rate of the electrode independently of the temperature of the slag bath and at the same time to ensure a good ingot surface.

SUMMARY OF THE INVENTION

The object is attained by providing a method producing ingots or billets of metal, in particular steels and Ni- and Co-based alloys, by melting away self-consuming electrodes in an electrically conductive slag bath using alternating or direct current in a short, downwardly open water-cooled mold by way of which current contact with respect to the slag bath can be made, wherein the melting current supplied is introduced into the slag bath both by way of the melting electrode and also by way of the mold controlledly regulatably in respect of the distribution of the current between the electrode and the mold and the return of the melting current can be implemented both by way of the mold and also by way of the ingot and the bottom plate selectively, wherein division of the currents is controlledly adjustable. An apparatus for carrying out the method comprises a short water-cooled mold with a bottom plate and at least one current-conducting element which is provided in the region of the slag bath and which is insulated with respect to the lower region of the mold, which forms the remelt ingot, and/or with respect to other current-conducting elements, characterised in that the feed line of the melting current from at least one current source both to the melting electrode and also to at least one current-conducting element is specifically adjustable individually or jointly by a suitable arrangement and that the return to the at least one current source both from at least one current-conducting element of the mold and also the bottom plate supporting the remelt ingot is specifically adjustable either individually or jointly.

The above-outlined object is attained in a surprisingly simple fashion if, for remelting self-consuming electrodes under slag, a per se known chill mold is used, with current-conducting elements which are fitted into the wall of the mold in the region of the slag bath and which are electrically insulated with respect to the lower part of the mold, which shapes the remelt ingot. In that way it is possible to heat the slag bath independently of the advance movement of the electrode by a feed of energy by way of the wall of the mold so that the metal sump can be kept fluid as far as the edge over the meniscus. On the other hand the melting rate of the consumable electrode can be controlled in a simple manner by the speed of advance movement with which it is advanced into the overheated slag bath.

In that respect, the melting electrode can be completely current-less. It is however also possible for a part of the current to be passed by way of the electrode.

The remelt ingots which are shaped in the lower part of the mold can either be withdrawn downwardly therefrom or the mold is lifted as the ingot standing on a bottom plate grows.

The subject of the present invention is therefore a method of producing ingots or billets of metals, in particular steels and Ni- and Co- based alloys by melting self-consuming electrodes in an electrically conducting slag bath in a short, downwardly open water-cooled mold, by way of which a current contact can be made with the slag bath in per se known manner, wherein the supplied melting current is introduced into the slag bath both by way of the melting electrode and the mold controlledly regulatably in respect of the distribution of the current between the electrode and the mold and the return of the melting current is effected selectively both by way of the mold and also the ingot and the bottom plate, wherein division of the current can be controlledly adjusted. In addition it has proven to be desirable if the proportion of current supplied by way of the melting electrode can be 0 to 100% of the total melting current supplied. The proportion of the current returned by way of the bottom plate to the melting current supply means can likewise be 0 to 100% of the total melting current supplied.

This method according to the invention which is set forth here from the point of view of its principle can be adapted in many ways to the requirements of the operator.

Thus for example the short, current-conducting mold can be fixedly installed in a working platform and the remelt ingot can be drawn off downwardly.

It is however also possible for the ingot to be built up on a fixed bottom plate and for the mold to be lifted as the ingot grows. The operation of withdrawing the ingot or lifting the mold can be effected continuously or stepwise.

There is also the possibility of causing the mold to oscillate, which can be an attractive proposition in particular when the ingot is drawn off continuously.

In the case of a stepwise movement for withdrawing the ingot or a stepwise movement for lifting the mold, each lifting step can additionally be directly followed by an opposed step, in which respect the length of that step can be up to 60% of the step length of the withdrawal stepping movement.

If in accordance with the invention the melting current supply means used is a direct current source, then by the installation of a pole change-over switch in relation to each of the two melting current supply means it is possible to connect the feed in all the above-indicated variants either as the cathode or as the anode.

It has also proven to be desirable, by exchanging the electrodes in the installations in accordance with the invention in per se known manner also to produce long remelt ingots—irrespective of the electrode length.

BRIEF DESCRIPTION OF THE DRAWINGS

Further advantages, features and details of the invention will be apparent from the description hereinafter of preferred embodiments by way of example and with reference to the drawing in which:

FIGS. 1, 2 and 4 each show a view in longitudinal section through a casting apparatus for metals with a chill mold, and FIG. 3 shows a view on an enlarged scale in section through FIG. 2 taken along line III—III thereof.

DETAILED DESCRIPTION

Figure 1:
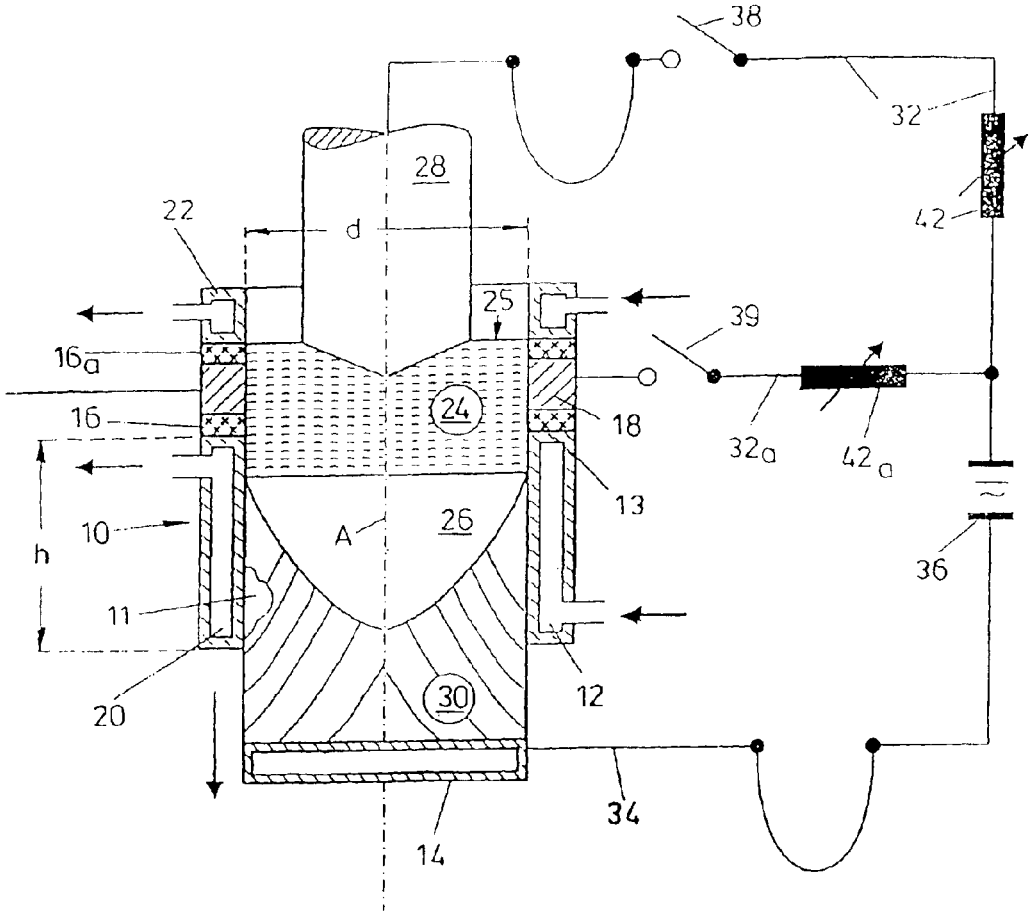

As shown in FIG. 1, associated from below with a water-cooled chill mold 10 with a hollow annular mold body 12 is a bottom plate 14—which is in turn hollow—and the outside diameter of which is slightly shorter than the inside diameter d of the mold 10; to start the installation, the bottom plate 14 can be pushed into the mold opening or the internal space 11 of the mold of the height h, until it extends directly beneath the upper edge 13 of the mold hollow body 12.

An annular insulating element 16 rests on the upper edge 13 and a current-conducting element 18—which is also of a ring-like configuration and/or is composed of a plurality of parts—rests on the insulating element 16; the current-conducting element 18 is electrically insulated by the insulating elements 16—which do not conduct the current—in relation to the water-cooled lower region 20 of the mold 10 and is separated upwardly by an upper insulating element $\mathbf{16}_a$ from a hollow ring 22 which in turn is water-cooled, as the upper region. It will be noted however that the upper insulating element $\mathbf{16}_a$ is not absolutely necessary for the use according to the invention of the installation described here.

Supported on the bottom plate 14—beneath a slag bath 24 and a sump 26 covered thereby—is a remelt ingot or pre-ingot 30 which is produced by a remelting process with self-consumable electrode 28 and which is shaped in the water-cooled lower region 20 of the mold 10. In order to start the procedure, for example liquid slag can be poured into the mold gap delimited by the mold 10 and the electrode 28 until the level of slag 25 of the resulting slag bath 24 has approximately reached the upper edge of the current-conducting element $\mathbf{16}_a$.

The electrode 28 on the one hand and the bottom plate on the other hand are connected by way of heavy-current lines

32, 34 to a respective pole of a direct current or alternating current source 36; branching from the line 32 is a heavy-current line $\mathbf{32}_a$ which at the other end is connected to the current-conducting element 18. The feed of the melting current to the slag bath 26 from the alternating current or direct current source 36 is effected—depending on the respective position of heavy-current contacts 38 and 39 connected by the lines 32, $\mathbf{32}_a$ —either only by way of the electrode 28 or only by way of the current-conducting element 18 of the mold 10 or however by way of the electrode 28 and the mold 18 at the same time, wherein the proportion of the current flowing by way of the electrode 28 or the current-conducting element 18 can be adjusted as desired by regulatable resistors 42, $\mathbf{42}_a$ or other devices which are comparable in terms of their effect. In this arrangement, the return of the entire melting current is effected exclusively by way of the remelt ingot 30 and the downwardly movable bottom plate 14 by the return line 34.

In another arrangement as shown in FIG. 2, the mold 10 is provided with at least two current-conducting elements 18, $\mathbf{18}_a$ which are insulated by insulating elements 16, $\mathbf{16}_a$ both relative to each other and also relative to the lower region 20 of the mold 10 and—here necessarily—relative to the upper region 22 of the mold 10, namely the hollow ring 12. In that respect FIG. 3 shows two respective part-circular current-conducting elements 18, $\mathbf{18}_a$ which are separated from each other by suitably shaped insulating elements $\mathbf{16}_b$ —forming a ring with them; if—as described here—two or more current-conducting elements 18, $\mathbf{18}_a$ which are at different potentials are required, then, particularly in the case of molds 10 of circular cross-section around a longitudinal axis A, the current-conducting elements can also be of a circular configuration in the form of a ring and can be arranged one above the other and can be insulated relative to each other by the insulating elements 16 which are arranged therebetween and which are also in the form of a ring.

If the return is effected by way of a current-conducting element 18 in the mold 10 and the bottom plate 14 jointly, then regulatable resistors 44 and $\mathbf{44}_a$ in the return 34 connecting the bottom plate 14 to the current source 36 and a line 35 which connects the current source 36 to the current-conducting element or elements 18 and is attached to the return line 34—or another device which is comparable in action—permit adjustment of the proportion of current flowing back by way of the bottom plate 14.

Figure 4:
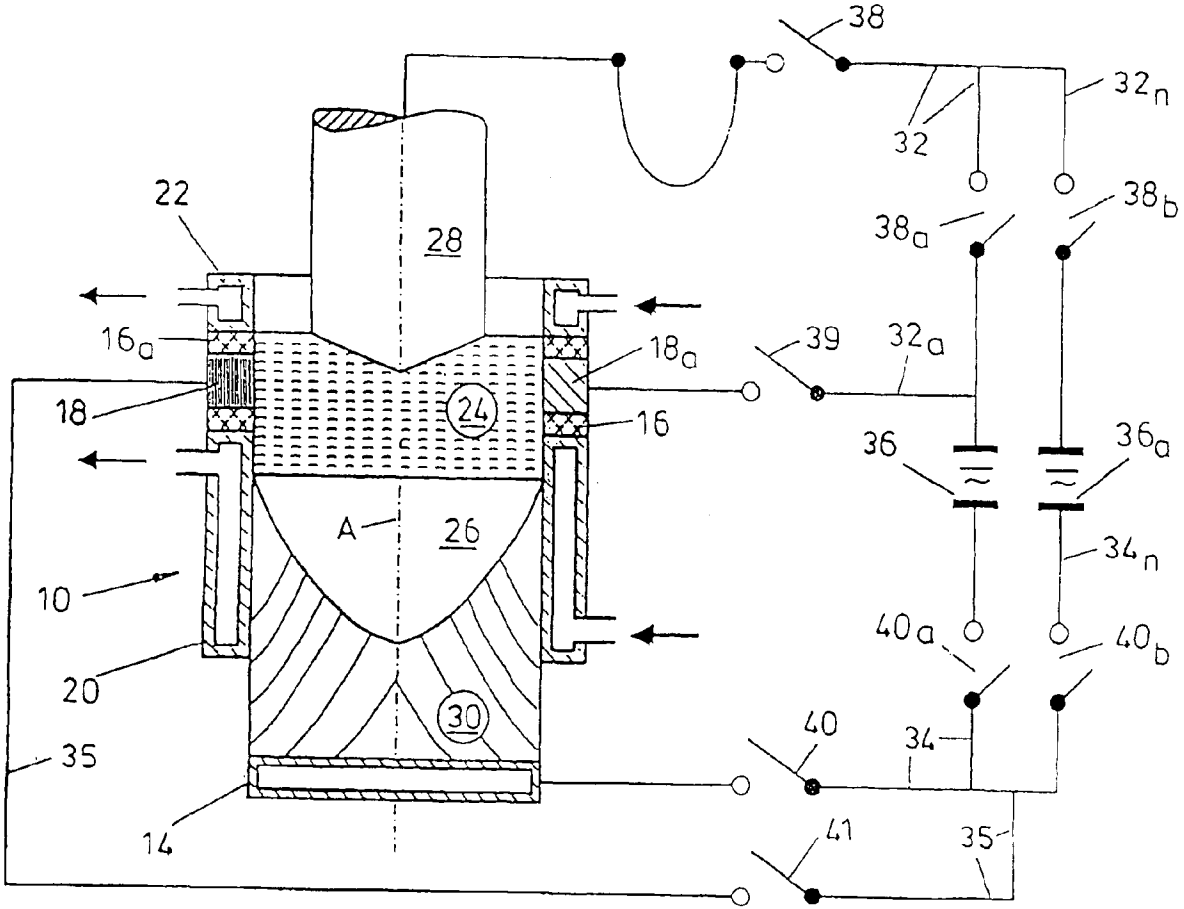

FIG. 4 shows an arrangement for carrying out the method according to the invention with two regulatable current sources 36, $\mathbf{36}_a$ which are arranged in parallel for the melting current supply. In this case the feed of the melting current from each of the two current sources 36, $\mathbf{36}_a$ can be effected individually or jointly either only to the electrode 28 or only to the current-conducting element $\mathbf{18}_a$—or to both jointly—, this depending on the respective position of the heavy-current switches 38, $\mathbf{38}_a$, $\mathbf{38}_b$ or 39 in the lines 32 or $\mathbf{32}_a$ respectively or the heavy-current switch $\mathbf{38}_b$ in the branch line $\mathbf{32}_n$ between the current source $\mathbf{36}_a$ and the electrode 28.

The return of the melting current can also be effected to one of the two current sources 36, $\mathbf{36}_a$ or to both jointly from the current element 18 in the mold 10 and/or the bottom plate 14 individually or jointly, depending on the respective position of the heavy-current switch 40, $\mathbf{40}_a$ or 41 arranged in the return line 34 or 35 respectively or the heavy-current switch $\mathbf{40}_b$ in a branch line $\mathbf{34}_n$ connecting the return line 34 to the second current source $\mathbf{36}_a$. The switching options which this arrangement allows when using alternating current are summarised in Table 1 hereinafter. The disclosure thereof is of particular significance in accordance with the invention.

TABLE 1

Switching options with two current supply means and current-conducting mold

| Circuit | Transformer | Feed line | Return | Closed to/back | Open to/back |
|---|---|---|---|---|---|
| 1 | 36 | Electrode | Ingot | 38, 38b/40, 40a | 39, 38b/41, 40b |
| 2 | 36 | Electrode | Mold | 38, 38b/41, 40a | 39, 38b/40, 40b |
| 3 | 36 | Electrode | Ingot & mold | 38, 38b/40, 41, 40a | 39, 38b/40b |
| 4 | 36 | Mold | | 39/40, 40a | 38, 38a, 38b/41, 40b |
| 5 | 36 | Mold | Ingot | 39/41, 40a | 38, 38a, 38b/40, 40b |
| 6 | 36 | Mold | Mold | 39, 40/41, 40a | 38, 38a, 38b/40b |
| 7 | 36 | Electr. & | Ingot & mold | 38, 39, 38a/40, 40a | 38b/41, 40b |
| 8 | 36 | mold | | 38, 39, 38a/41, 40a | 38b/40, 40b |
| 9 | 36 | Electr. & mold | Ingot | 38, 39, 38a/40, 41, 40a | 38b/40b |
| | | Electr. & mold | Mold | | |
| | | | Ingot & mold | | |
| 10 | 36a | Electrode | Ingot | 38, 38b/40, 41a | 39, 38a/41, 40a |
| 11 | 36a | Electrode | Mold | 38, 38b/41, 40b | 39, 38a/40, 40a |
| 12 | 36a | Electrode | Ingot & mold | 38, 38b/40, 41, 40a | 39, 38a/40a |
| 13 | 36a | Mold | | 39, 38a, 38b/40, 40b | 38/41, 40a |
| 14 | 36a | Mold | Ingot | 39, 38a, 38b/41, 40b | 38/40, 40a |
| 15 | 36a | Mold | Mold | 39, 38a, 38b/40, 41, 40b | 38/40a |
| 16 | 36a | Electr. & | Ingot & mold | 38, 39, 38a, 38b/40, 40b | —/41, 40a |
| 17 | 36a | mold | | 38, 39, 38a, 38b/41, 40a | —/40, 40a |
| 18 | 36a | Electr. & mold | Ingot | 38, 39, 38a, 38b/40, 41, 40b | —/40b |
| | | Electr. & mold | Mold | | |
| | | | Ingot & mold | | |
| 19 | 36 + 36a | Electrode | Ingot | 38, 38a, 38b/40, 40a, 40b | 39/41 |
| 20 | 36 + 36a | Electrode | Mold | 38, 38a, 38b/41, 40a, 40b | 39/40 |

TABLE 1-continued

Switching options with two current supply means and current-conducting mold

| Circuit | Transformer | Feed line | Return | Closed to/back | Open to/back |
|---|---|---|---|---|---|
| 21 | 36 + 36a | Electrode | Ingot & mold | 38, 38a, 38b/40, 41, 40a, 40b | 39/— |
| 22 | 36 + 36a | Mold | | 39, 38a, 38b/40, 40a, 40b | 38/41 |
| 23 | 36 + 36a | Mold | Ingot | 39, 38a, 38b/41, 40a, 40b | 38/40 |
| 24 | 36 + 36a | Mold | Mold | 39, 38a, 38b/40, 41, 40a, 40b | 38/— |
| 25 | 36 + 36a | Electr. & mold | Ingot & mold | 38, 39, 38a, 38b/40, 40a, 40b | —/41 |
| 26 | 36 + 36a | | | 38, 39, 38b/40, 40a, 40b | 38a/41 |
| 27 | 36 + 36a | Electr. & mold | Ingot | 38, 39, 38a, 38b/41, 40a, 40b | —/40 |
| 28 | 36 + 36a | | Ingot | 38, 39, 38b/41, 40a, 40b | 38a/40 |
| 29 | 36 + 36a | Electr. & mold | Mold | 38, 39, 38a, 38b/40, 41, 40a, 40b | —/— |
| 30 | 36 + 36a | | Mold | 38, 39, 38b/40, 41, 40a, 40b | 38a/— |
| | | Electr. & mold | Ingot & mold | | |
| | | Electr. & mold | Ingot & mold | | |
| | | Electr. & mold | | | |

The electrode and the slag bath can be protected from the access of air by gas-tight hoods (not shown here) which can also be sealed off in relation to the mold flange. In that way the remelting procedure can take place under a controlled atmosphere and with the exclusion of oxygen in the air, thereby also making it possible to produce remelt ingots of very high purity and preventing elements with affinity from oxygen from burning away.

EXAMPLE

A test was carried out on an ESR installation with lifting molds 10, in which the supply of current to the slag bath 24 was both by way of the melting electrode 28 and also the mold 10 and the return was by way of the ingot 30 and the bottom plate 14.

| | |
|---|---|
| Mold | Cylindrical mold of 500 mm diameter with a current-conducting ring in the region of the slag bath, which was electrically insulated relative to the lower part |
| Melting electrode: | 320 mm diameter |
| Steel | CK 45 |

After the step of melting 75 kg of slag of the composition 30% CaO, 30% $Al_2O_3$ and 40% $CaF_2$ firstly the entire melting current was passed by way of the electrode and it was remelted in accordance with the conventional ESR process until the level of slag covered the mold ring with the current feed. Up to that point about 470 kg of the electrode had been melted away. The melting rate was finally 460 kg/h with a power feed to the slag bath of 450 kW, the current strength being 8.0 Ka at 58 V secondary voltage. From that moment in time the mold lifting movement was so adjusted that the level of steel was kept approximately 30 to 50 mm below the insulation in relation to the current-conducting ring of the mold and the latter was thus always held in the region of the slag bath. As from the attainment of the current-conducting ring, the melting current was divided between the current-conducting ring and the melting electrode, while at the same time the transformer voltage was reduced to 44 V.

Subsequently the current by way of the electrode fell to 6.1 kA while a flow of current by way of the mold of 11.4 kA took place. The corresponding active powers were 27 kW at the electrode and 385 kW by way of the mold. Under those conditions the melting rate fell to 390 kg/h. Melting was conducted for about 3.5 hours under those conditions. Then the supply of energy to the electrode was switched off so that the feed of melting current was effected exclusively by way of the mold. The voltage at the transformer was again increased to 55 V, which resulted in an increase in the mold current to 13.9 kA. The feed of power to the slag bath was set to 480 kW while at the same time the melting rate fell to 275 g/h.

After a further 2 hours the feed of current was switched off and the ingot removed from the installation. The ingot produced, over the entire length thereof and in particular also in the upper part which was formed at a low melting rate, had a smooth surface which exhibited neither grooves nor overlaps. The structure of the ingot produced, after the forging operation, was satisfactory over the entire length.

What is claimed is:

1. A method for producing an ingot of metal comprising the steps of:

providing a downwardly open water-cooled mold containing a slag bath and a pre-ingot below the slag bath and supported on a bottom plate;

locating a self-consumable electrode in the slag bath;

supplying current to the slag bath for melting the self-consumable electrode, to produce an ingot wherein the current is supplied to both the mold and the self-consumable electrode and selectively divided therebetween; and returning the melt current from the slag bath, wherein the current is returned from both the mold and at least one of the ingot and bottom plate and selectively divided therebetween.

2. A method as set forth in claim 1 wherein the current is direct current and the feed and the return for the current are interchanged.

3. A method as set forth in claim 1, wherein the ingot is continuously withdrawn from the mold.

4. A method as set forth in claim 3 wherein the billet formed ingot is withdrawn from the mold in a stepwise manner.

5. A method as set forth in claim 1 wherein the ingot is stationary and the mold is continuously moved.

6. A method as set forth in claim 5 wherein the mold is moved in a stepwise.

7. A method as set forth in claim 2 wherein the mold is oscillated.

8. A method as set forth in claim 5 or 6 wherein the moving step is immediately followed by an opposite step in the opposite direction, wherein the stroke length of the opposite step is at most 60% of the stroke length of the preceding moving step.

9. Apparatus for producing an ingot comprising a short water-cooled mold with a bottom plate and at least one current-conducting element which is provided in the region of the slag bath and which is insulated with respect to a lower region of the mold wherein a feed line for the melting current from at least one current source is connected to both a melting electrode and to an at least one current-conducting element and means for selectively dividing the current therebetween, and a return line to the at least one current source both the at least one current-conducting element of the mold and the bottom plate supporting a remelt ingot and means for selectively dividing the return melt current therebetween.

10. Apparatus as set forth in claim 9 wherein from the current source a respective feed line is passed to the melting electrode and another feed line is passed to the current-conducting element.

11. Apparatus as set forth in claim 9 wherein return lines pass to the current source from the bottom plate and the current-conducting element.

12. Apparatus as set forth in claim 9 wherein a plurality of current-conducting elements separated by insulating elements are arranged in a horizontal line of the mold.

13. Apparatus as set forth in claim 12 wherein the current-conducting elements with the insulating elements form a ring.

14. Apparatus as set forth in claim 13 wherein two current-conducting elements of which one is connected to the feed line and one to the return line.

15. Apparatus as set forth in claim 9 wherein two current sources of which one is connected to the melting electrode, wherein the other current source is connected both to the melting electrode and also to the current-conducting element.

16. Apparatus as set forth in claim 9 wherein division of the current strengths between the individual feed and return lines respectively is adjustable by regulatable resistors.

17. Apparatus as set forth in claim 9 wherein two mutually independently regulatable current sources are arranged.

18. Apparatus as set forth in claim 9 wherein rectifier installations as a current source or sources, the polarity of which is adapted to be switched over.

* * * * *